United States Patent [19]

Vail

[11] 4,012,045

[45] Mar. 15, 1977

[54] JURISPRUDENCE -EDUCATIONAL GAME

[76] Inventor: James N. Vail, 900 Golfview Drive, Glenview, Ill. 60025

[22] Filed: May 5, 1975

[21] Appl. No.: 574,697

[52] U.S. Cl. ..... 273/134 B; 273/134 C; 273/134 D

[51] Int. Cl.[2] ..... A63F 3/00

[58] Field of Search ..... 273/134

[56] References Cited

UNITED STATES PATENTS

| | | | |
|---|---|---|---|
| 1,635,734 | 7/1927 | Ziegler | 273/134 AC |
| 2,174,058 | 9/1939 | McGennis | 273/134 AF |

*Primary Examiner*—Delbert B. Lowe
*Attorney, Agent, or Firm*—James T. FitzGibbon

[57] ABSTRACT

A teaching device and game comprising a game board bearing instructions; marker pieces; dice for determining by lot the advancement and position of the marker pieces; reward indicator members representing "jurors" to be won or lost by each participant who, having been accused of a "crime", stands in the position of a criminal "defendant"; a variety of game elements or cards representing a variety of different criminal indictments, criminal defenses, and questions relating to various criminal and constitutional evidentiary situations, which, if answered correctly, gain reward indicators or "jurors" for the participant, the ultimate goal being to become the first participant to accumulate a predetermined number of "jurors" and thereby to be found "not guilty".

7 Claims, 1 Drawing Figure

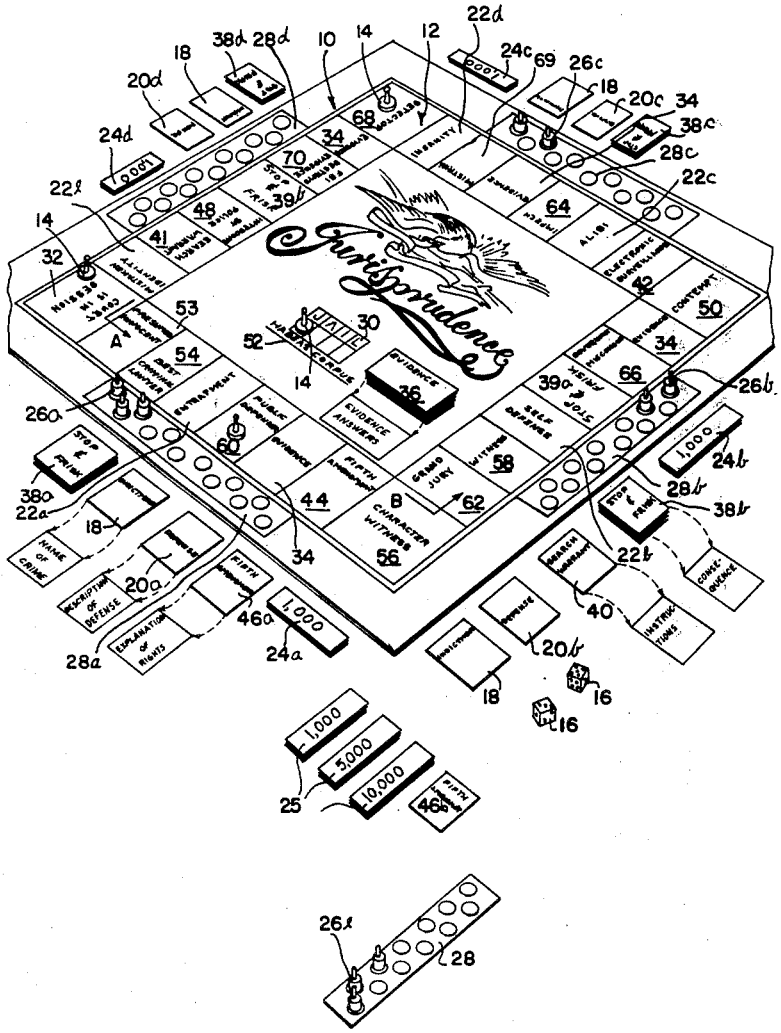

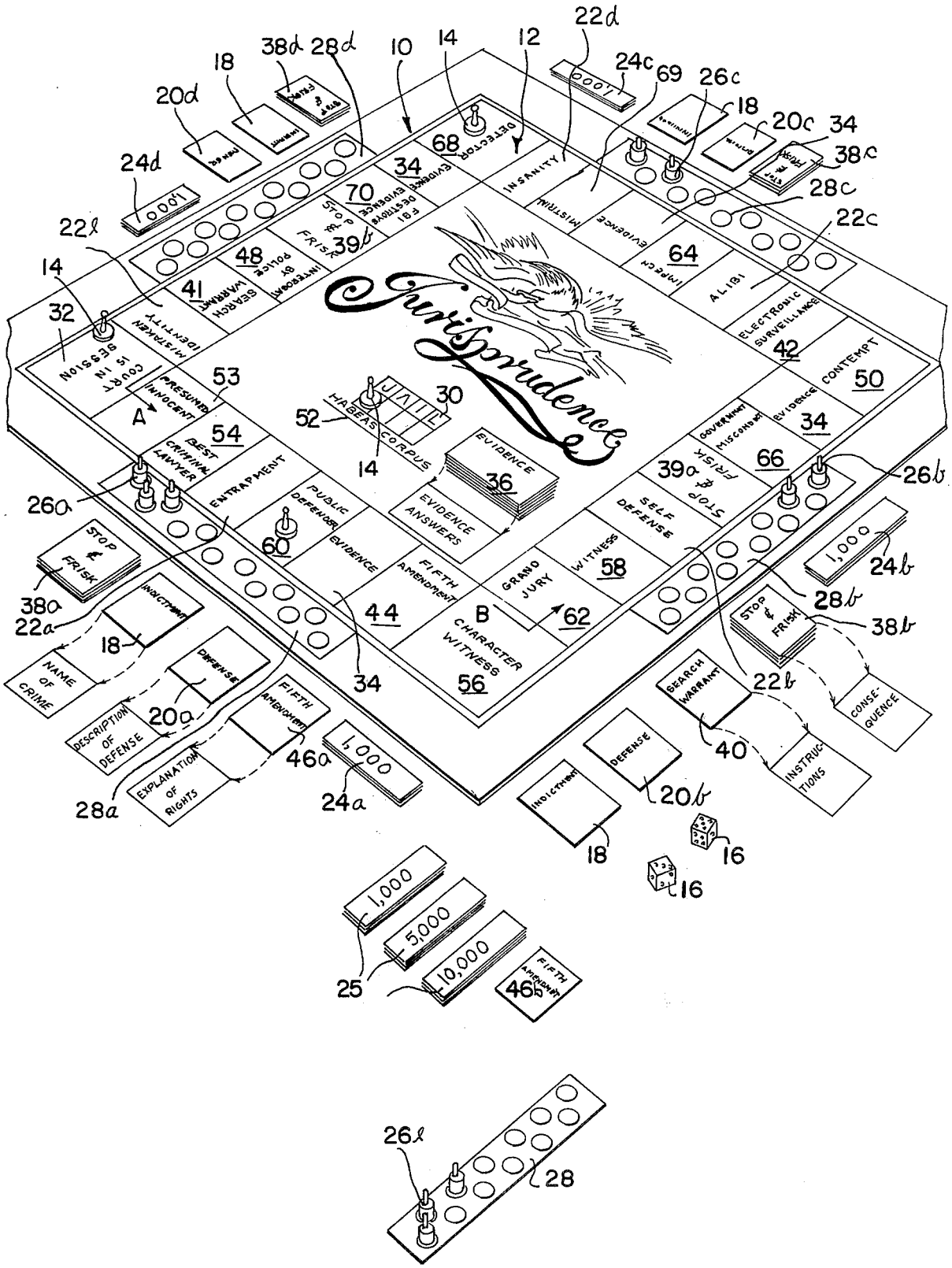
Jurisprudence
DETECTIVE
INSANITY
MISTRIAL
EVIDENCE
IMPEACH
ALIBI
ELECTRONIC SURVEILLANCE
CONTEMPT
GOVERNMENT MISCONDUCT
EVIDENCE
STOP & FRISK
SELF DEFENSE
WITNESS
GRAND JURY
CHARACTER WITNESS
FIFTH AMENDMENT
EVIDENCE
PUBLIC DEFENDER
ENTRAPMENT
BEST CRIMINAL LAWYER
PRESUMED INNOCENT
COURT IS IN SESSION
MISTAKEN IDENTITY
SEARCH WARRANT
INTERROGATE BY POLICE
STOP & FRISK
EVIDENCE
JAIL
HABEAS CORPUS
EVIDENCE
EVIDENCE ANSWERS
INDICTMENT
NAME OF CRIME
DEFENSE
DESCRIPTION OF DEFENSE
EXPLANATION OF RIGHTS
FIFTH AMENDMENT
SEARCH WARRANT
CONSEQUENCE
INSTRUCTIONS
DEFENSE
INDICTMENT
1,000
5,000
10,000
FIFTH AMENDMENT

JURISPRUDENCE -EDUCATIONAL GAME

BACKGROUND OF THE INVENTION

The present invention relates generally to teaching devices which are entertaining as well as educational. More particularly, the present invention relates to an entertaining teaching device in which the intended result of use is the exposure to and learning of the principles of criminal and Constitutional law and procedure, so that the participant may better become aware of a citizen's rights and responsibilities in a free society under law.

Many prior art games involving the use of game boards, marker pieces, dice or other chance apparatus, instructional cards, and simulated money and/or other simulated reward means have been heretofore known. Among these are U.S. Pat. No. 3,679,210 to Breslow relating to the subject of art and artists.

These prior art games typically involve the use of a chance apparatus to dictate the movement of a marker piece along a path on a game board. Such game boards usually have various areas thereon containing instructions for further movement and present the player with an opportunity to exercise certain decisions regarding a supply of simulated money, or in conjunction with certain other simulated rewards. Typically, the object of such games is the accumulation of the greatest possible amount of simulated money or other simulated reward, at the expense of the other players and/or the "bank". Such games have been popularly received because, in general, they have been easy to understand and play and have provided a certain amount of psychological satisfaction to the winner. However, such games have seldom been of any significant educational value to the participant, since the chief purpose involved was that of entertainment by gaining simulated wealth. In these games, whatever learning was done pertained only to the arbitrary rules of the individual game, rather than to anybody of knowledge having an important, independent existence.

On the other hand, many teaching techniques of the prior art have involved such dull activities as rote memorization, incessant repetition, and the like. Often, these techniques have been counterproductive from the standpoint that the student, faced with boring teaching tenchiques, would transfer his disenchantment with the teaching technique to particular subject matter involved. The attractiveness of learning should not be diminished by use of dull techniques because, with proper teaching techniques, learning can be entertaining, as well as educational.

An object of the present invention is to provide a unique combination teaching device and game which will overcome certain disadvantages and deficiencies of the prior art.

Another object of the present invention is to provide a teaching device and game having features such that, by participation therein, principles of criminal law and procedure may be readily learned and retained.

Yet another object of the present invention is to provide a teaching device and game which will provide an incentive to learn the principles of criminal and Constitutional law and practice.

A further object of the present invention is to provide a teaching device and game having a game board, chance means, reward means, maker pieces and a variety of instructional cards, whereby the participants may be taught the evidentiary fundamentals of criminal procedure and Constitutional law in order better to know their Constitutional rights and, hence, be better functioning citizens within a free society.

Yet a further object of the present invention is to provide a teaching device and game wherein the instructional cards which correspond to various areas on the game board provided therefor relate to various fact situations between the various participants, and/or "society", including criminal indictments, criminal defenses, criminal evidentiary situations, stop and frisk situations, and electronic surveillance situations.

The foregoing objects and others are accomplished in accordance with the present invention by providing an entertaining teaching device of unique characteristics. In one form, such teaching device includes a game board with a closed path thereon bearing instructions. Marker pieces are used to record the position of each participant on the closed path. Random or chance selection means in the form of dice are used for determining the advancement and ultimate positioning of the marker pieces. Reward indicator means represent "jurors" to be won by a participant who, having been accused of a "crime", stands in the position of a "defendant" in a criminal case.

In the educational game of the present invention the factual and legal situation confronting a participant is that of a person facing the accusation of a crime. Each participant is indicated and faced with the necessity of conducting his criminal defense. Each participant is provided with a limited supply of money for obtaining the services of a lawyer, criminal bond, etc. During the pre-trial and trial stages he or his attorney is faced with various choices of action which most often occur in at least partially random sequence. In such a situation, his knowledge of Constitutional law and practice to be used in reacting to the various situations will either resolve or aggravate his defense difficulties and will be largely determinative of his ultimate fate, i.e., whether he will be found guilty or not guilty. Thus, a knowledge of the law, as exercised by use of the present invention is simulated situations, serves to make the citizen more aware of his Constitutional rights.

A variety of game elements or cards are provided and represent, among other things, a variety of different criminal "indictments" and criminal "defenses". Also provided are evidence cards bearing questions relating to various evidentiary situations, which, if answered correctly, gain reward indicators or "jurors" for the participant, the ultimate goal being to become the first participant to accumulate twelve or other number of "jurors", and thereby to be found "not guilty".

In a preferred form, each participant is provided with an equal number of "stop and frisk" cards, one of which may be examined by a participant whose marker comes to rest on a corresponding area on the game board. Such "stop and frisk" cards bear further instructions relating to the gain or loss of "jurors".

In addition to such "indictment", "defense", "evidence", and "stop and frisk" cards, in the preferred embodiment "search warrant" and "electronic surveillance" cards may be provided to correspond to one or more areas on the game board, which areas bear instructions for their use. The elements of the present invention having been set forth generally, reference will now be made to the drawing for a more specific recitation of the structure and function thereof.

BRIEF DESCRIPTION OF THE DRAWING

The drawing is a perspective view of a game board containing pre-marked areas, marker pieces showing player positions, the various game cards, and random means, showing such various elements appearing as in the position of actual use.

The following detailed description is intended to be merely illustrative of the basic principles of the present invention and no limitation of the claims appended hereto is meant thereby.

DESCRIPTION OF THE PREFERRED EMBODIMENTS OF THE INVENTION

The principles of the present invention are applicable to many uses. However, in the preferred embodiment of the educational game described hereinbelow means are provided for the initial indictment of each participant for a criminal offense. Also provided are means for conducting a criminal defense by each participant, wherein all players are bound by the same criminal and Constitutional law and practice, relating to such legal areas as confinement, evidence, search and seizure, etc., all as affected by random means. Means are also provided for affording each participant opportunities to either resolve or aggravate the difficulties presented during the course of conducting his criminal defense by requiring each such participant to display his knowledge of criminal and Constitutional law and practice at various times as affected by the random means. The provided random means determine the order and frequency of such opportunities for resolution or aggravation of criminal defense difficulties and to that extent only may be regarded as chance means.

Referring now to the drawing, the present invention is shown to be embodied in an entertaining teaching device for two or more participants or players, which device includes a game board 10 having thereon a plurality of discrete areas 12 arranged along a closed directional path A-B (See arrows A and B). Marker pieces 14 are provided to indicate each participant's movement and position along such path A-B, as determined by random means 16, which may be in the form of dice, as shown in the drawing, or alternatively may be a spinner, or various other chance means.

A plurality of first game elements, or "indictment" cards 18 are provided. At the outset, each participant receives one such indictment card, which represents a simulated accusation of a simulated crime and bears on its underside the name of the crime, such as, for example, armed robbery, kidnapping, counterfeiting, murder, burglary, or any other criminal offense.

Each participant next receives a second game element or "defense" card 20-a-d, each of which represents a simulated defense corresponding to a simulated crime, such as described on the indictment cards 18, but not necessarily corresponding to the particular indictment card held by that particular participant. Each "defense" card bears on its underside a description of the defense. To be used in connection with certain of the defense cards 20 are certain defense areas on game board 10 which specifically correspond thereto, such as, for example, entrapment area 22*a*, self-defense area 22*b*, alibi area 22*c*, insanity area 22*d*, and mistaken identity area 22*e*, the use of which areas is set forth more fully hereinbelow.

Each participant further receives a sum of simulated money 24*a—d*, to be used to aid the accumulation of reward indicators or"jurors" 26. Such jurors 26 are accumulated by each participant in his jury box 28, which has space for twelve such "jurors". The Government retains the balance 25 of the simulated money and receives all payments of funds, unless otherwise indicated.

Initially, a participant must begin with his marker 14 in jail area 30. Upon payment of a designated amount of simulated money 24, a participant's marker piece 14 is transferred to the "court is in session" area 32. Random means 16 are then utilized in an appropriate order by each participant to determine by lot the subsequent advancement and position of his marker piece 14.

At one time or another during the course of use, a participant's marker piece 14, in response to random means 16, may come to rest on one of the "evidence" areas 34. When this occurs, that participant must draw from the stack thereof a third game element or "evidence" card 36. Each evidence card 36 has on the upper surface thereof a question relating to criminal or Constitutional law and practice with the answer to the question printed on the under surface thereof.

In a preferred method of playing the game of the present invention, the first participant may answer such evidence question himself. If he does so correctly, he gains one juror 26a from the "Government"; if he does so incorrectly, he loses one such juror 26 to the Government, which juror 26 is then placed in the Government jury box 28. Alternatively, the participant may not elect to answer the question, but may instead transfer the obligation of answering such evidence question to a second participant. If such second participant answers correctly, there is no penalty or reward; but, if such second participant answers incorrectly, the first participant gains one of the second participant's previously acquired jurors. If a participant has no previously accumulated jurors and answers incorrectly, he need not owe a juror to the "Government" or to another participant. As an alternative feature, participants may be required to give proper legal reasons for their particular answers or suffer loss of a juror 26.

If and when, during the course of participation, a participant's marker piece 14 comes to rest on that particular defense area 22d-c which corresponds to the defense card 20*a* held by him, that participant receives one juror 26*e* from the Government. However, when a first participant's marker piece 14 comes to rest on the defense area 22d-e which corresponds to the particular defense card 20b held by another participant, the first participant must contribute one of his jurors 26*a* to such other participant.

As set forth hereinabove, before beginning, each participant has also received an equal number of fourth game elements, or "stop and frisk" cards 38*a–d*, which correspond to and cooperate with discrete stop and frisk areas 39*a*, *b*. When a first participant's marker piece 14 comes to rest on either of such areas 39*a* or 39*b*, such first participant may "search" a second participant by "seizing" one of said second participant's stop and frisk cards without, however, first looking at their undersides. Each such stop and frisk card bears on its underside simulations of various legal occurences together with directions relating to the loss or gain of simulated money 24 or jurors 26. Examples thereof are: false arrest, conspiracy, Supreme Court ruling in your favor, dangerous drugs, ineffective lawyer, accessory to a crime, concealed weapon, tax audit, obstruction of justice, court holiday, defense fund, and tampering with the jury, each with its own unique meaning to the participant drawing it.

Also provided in a preferred embodiment of the present invention is a fifth game element, which may preferably be a "search warrant" card 40 corresponding to a cooperating search warrant area 41 on board 10. Should a first participant's marker piece 14 come to rest on search warrant area 41, such participant is entitled to possession of search warrant card 40, until it is used or until a second participant's marker piece subsequently comes to rest on such search warrant area 41, in which case the possession of search warrant card 40 would be transferred to said second participant. Each "search warrant" card bears on its underside instructions on the use of this card. Search warrant card 40 may be used when its possessor's marker piece comes to rest on a "stop and frisk" area 39*a, b,* in which event search warrant card 40 gives its holder the right to examine fully each of the "stop and frisk" cards of any other participant in order to select the most advantageous among them.

One or more "electronic surveilance" areas 42 may also be provided. When a first participant's marker piece 14 comes to rest on such electronic surveilance area 42, he is entitled to look at a second participant's stop and frisk cards 38b and exchange one of his stop and frisk cards 38*a* therefor as such first participant desires.

A further feature contemplated by one form of the present invention is one or more "Fifth Amendment" areas 44 on board 10 corresponding to and cooperating with one or more "Fifth Amendment" cards 46*a, b.* When a first participant's marker piece 14 comes to rest on such Fifth Amendment area 44, such participant is entitled to possess a Fifth Amendment card 46*a* provided therefor unless and until such time as a second participant's marker piece subsequently comes to rest on Fifth Amendment area 44. A participant possessing a Fifth Amendment card 46 may properly "refuse" to answer a question found on any evidence card 36 he has otherwise become obligated to answer or respond to, and such participant need not surrender his Fifth Amendment card 46 after using it.

In addition to the above described alternative embodiments, other variations contemplated by the present invention include provision for one or more "interrogation by police" areas 48 on the game board 10. When a possessor of a Fifth Amendment card 46 lands on such interrogation by police area 48, that participant is entitled to receive a juror 26*e* from the "Government" and may leave such interrogation by police area 48 on his next turn. However, in certain other alternative embodiments of the present invention a non-possessor of a Fifth Amendment card 46 may not leave the interrogation by police area 48 until a specified number of turns or until random means 16 indicates a certain specified result on that participant's turn, such as the rolling of "doubles" where dice are used.

As a further feature of the present invention, if a participant has been unable to leave the interrogation by police area 48 after a certain number of turns, or if his marker piece 14 has come to rest on the "contempt of court" area 50, he is entitled to use the "habeas corpus" procedure 52, the instructions for which may be printed on board 10. Habeas corpus procedure 52 generally comprises bringing the participant's "body" or marker 14 to the "court in session" area 32, paying $1,000.00 of his simulated money 24 to his lawyer, and utilizing random means 16 to determine according to predetermined rules whether his habeas corpus motion is to be granted, in which case he can resume his "defense", i.e., resume his attempt to accumulate jurors 26. If the previous pursuit of his "defense" has exhausted his supply of simulated money 24, the court will appoint an attorney for such jailed participant free of charge, after which he may proceed with random means 16 and, if his habeas corpus motion is granted, his "defense". It is further contemplated that one of the stop and frisk cards 38 be entitled, "Supreme Court ruling in your favor", which entitles the holder thereof to cancel out any unfavorable ruling against him merely by presenting such card to the Government.

Further included on board 10 may also be miscellaneous areas bearing favorable instructions, such as: "presumed innocent" area 53, "best criminal lawyer" area 54, "character witness" area 56, and "witness" area 58. Other miscellaneous areas on board 10 may bear unfavorable instructions, such as: "court appoints public defender as your lawyer" area 60, "grand jury" area 62, and "impeachment" area 64. Still other areas on board 10, the instructions for which may be favorable or unfavorable depending on the result of a subsequent use of random means 16, may be: "Government misconduct" area 66, "lie detector" area 68, and "F.B.I. destroys evidence" area 70. Further provided may be a "mistrial" area 69, which bears instructions requiring a participant whose marker piece 14 lands thereon to return all jurors he may have accumulated, transfer his marker piece 14 to the court is in session area 32, and resume anew his criminal "defense".

The foregoing areas are selected and named so as to invite curiosity, discussion and resolution of questions by the players concerning commonly occurring fact situations and current court rulings, legal tactics, police practices and the conflict between and ultimate resolution thereof by society, including the judicial system.

The foregoing detailed description has been given for clearness of understanding only, and no unnecessary limitations are to be understood therefrom, as modifications of the present invention may be made by those skilled in the art without departing from the spirit thereof.

What is claimed is:

1. An entertaining and teaching game device comprising:

A game board having a plurality of various different discrete areas thereon which are arranged in a continuous path, said discrete areas including areas having identification thereon for cooperation with a plurality of game elements which have related identification thereon;

A plurality of marker pieces for marking movement along said path of two or more players;

Means for determining by lot increments of advance of marker pieces of successive players so as to position said marker pieces of said various discrete areas;

A plurality of game elements adapted for distribution to the players which game elements each have at least two faces with one of the faces thereof having an identification thereon which is related to the identification on certain of said discrete areas on said board and the other one of said faces having information thereon which requires a response by the player according to the knowledge of the player;

Certain of said game elements having on said other one of said faces information which requires the player to exercise his judgement according to his knowledge as to how best to respond in order to further his progress toward obtaining reward indicators;

Certain others of said game elements having information on said other one of said faces which enables the player to respond according to his knowledge and to obtain or lose reward indicators; and A plurality of reward indicators which are distributable to the players in accordance with their correctness in responding to the information on said game elements and to the positioning of said markers on certain of said discrete areas.

2. An entertaining and teaching game device as set forth in claim 1 wherein said game board is arranged with separate playing positions for each of a plurality of players which are positioned along the path defined by said discrete areas with one of said areas constituting a common starting point for a marker piece of each of the players and said board having at each of said playing positions an area for accommodating a predetermined number of reward indicators.

3. An entertaining and teaching game device as set forth in claim 1 wherein said game board has a discrete area positioned remote from the areas which are arranged in said continuous path, which remote area is subdivided so as to accommodate separate marker pieces for each said player at the start of the game and at periods thereafter when the progress of the player is interrupted as a result of incorrect response to the information on a game element.

4. An entertaining and teaching game device as set forth in claim 1 wherein certain of said game elements have on one of said faces identification which relates to the identification on the faces of certain other ones of said game elements and on another of said faces having information which will require a response by an opposing player affecting said opposing players progress toward obtaining reward indicators.

5. An entertaining and teaching game device as set forth in claim 1 wherein certain of said game elements have on said other one of said faces information requiring a response which will interrupt the progress of the player holding said game element toward obtaining reward indicators.

6. An entertaining and teaching game device as set forth in claim 1 wherein certain of said game elements have on said other one of said faces information which requires a response according to the players knowledge and which enables the holder to require a response from an opposing player the correctness of which will affect the opposing players progress toward obtaining reward indicators.

7. An entertaining and teaching game device comprising:

A game board having a plurality of various different discrete areas thereon which are arranged in a continuous path along which each player may indicate his progress by a marker, said discrete areas having identification thereon for cooperation with a plurality of game elements which have related identification thereon and the use of which may affect the players' progress along said path and the accumulation of a desired number of reward indications;

Means for determining by lot increments of advance of markers indicating progress of the players along said path;

A plurality of game elements adapted for distribution to the players which game elements each have a face with an identification thereon which is related to the identification on certain of said discrete areas;

Said game elements each having on another face thereof information which requires the player to respond in a way that will affect his success or lack of success in obtaining said predetermined number of reward indications;

Certain of said game elements having on a face thereof information requiring the player to exercise his judgment on how to proceed in order to further his progress toward obtaining the desired number of reward indications; and Certain of said game elements having on a face thereof information requiring the player to respond according to his knowledge so as to obtain further reward indications when his response is correct.

* * * * *